US006478207B2

(12) United States Patent
Ehmig et al.

(10) Patent No.: US 6,478,207 B2
(45) Date of Patent: Nov. 12, 2002

(54) HOLDER FOR A DRIVE PISTON OF A SETTING TOOL

(75) Inventors: Gerhard Ehmig, Rankweil (AT); Norbert Heeb, Buchs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/059,853

(22) Filed: Jan. 29, 2002

(65) Prior Publication Data

US 2002/0108987 A1 Aug. 15, 2002

(30) Foreign Application Priority Data

Feb. 9, 2001 (DE) ..... 101 05 882

(51) Int. Cl.[7] ..... B25C 1/14
(52) U.S. Cl. ..... 227/10; 173/211
(58) Field of Search ..... 227/9, 10, 11, 227/130; 173/210, 211

(56) References Cited

U.S. PATENT DOCUMENTS

| | | | | | |
|---|---|---|---|---|---|
| 4,867,365 | A | * | 9/1989 | Buechel et al. | 227/9 |
| 4,941,391 | A | * | 7/1990 | Ehmig et al. | 227/10 |
| 5,538,172 | A | * | 7/1996 | Jochum et al. | 227/130 |
| 5,797,534 | A | * | 8/1998 | Almeras et al. | 227/10 |
| 5,881,940 | A | * | 3/1999 | Almeras et al. | 227/10 |
| 6,092,710 | A | * | 7/2000 | Kersten | 173/211 |
| 6,123,243 | A | * | 9/2000 | Pfister et al. | 227/10 |

* cited by examiner

*Primary Examiner*—Scott A. Smith
(74) *Attorney, Agent, or Firm*—Sidley Austin Brown & Wood, LLP

(57) ABSTRACT

A piston holder for a drive piston (8) of a setting tool and including a circumferential groove (15) provided in a stationary, with respect to the setting tool, component of the setting tool and surrounding the drive piston (8), with the circumferential groove (15) becoming shallower in a drive-out direction of the drive piston (8), and an O-shaped helical tension spring (21) located in the circumferential groove (15) and concentrically surrounding the drive piston (8).

9 Claims, 2 Drawing Sheets

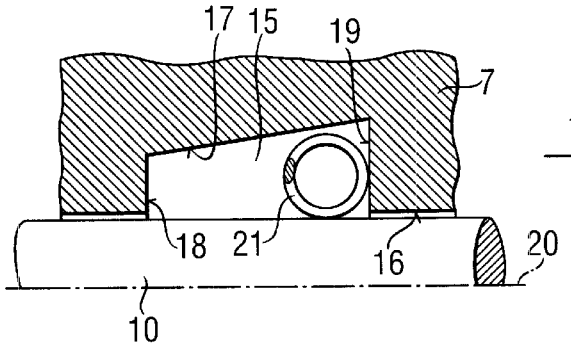
Fig. 2
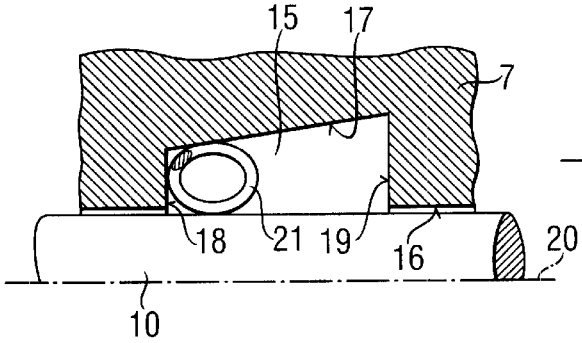
Fig. 3
Fig. 4
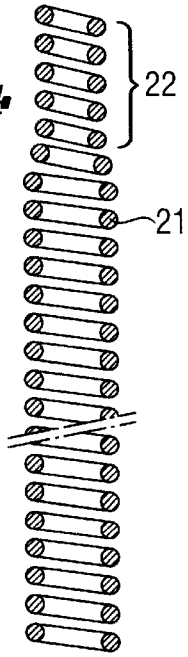
Fig. 5
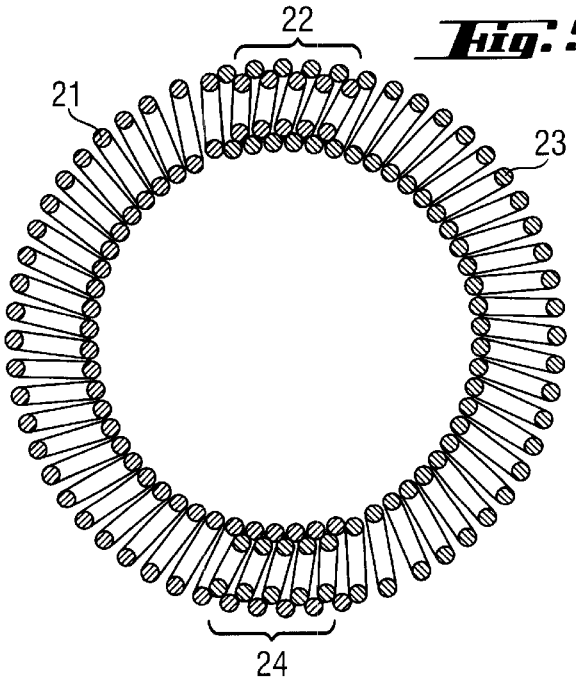

HOLDER FOR A DRIVE PISTON OF A SETTING TOOL

BACKGROUND OF THE INVENTION

1. Field of the Invention

The present invention relates to a holder for a drive piston of a setting tool.

2. Description of the Prior Art

European Publication EP-O 346275 B1 discloses an explosive powder charge-operated setting tool including a piston guide and a drive piston displaceable in the piston guide. The piston guide has radial openings facing the drive piston, and spring-biased braking balls extending through the radial openings and engaging the drive piston. The spring, which applies a biasing force to the braking balls is formed as a ring spring for applying a radially acting, with respect to the piston, biasing force to the braking balls. The ring spring is provided on its inner profile with a bearing surface acting on the braking ball. The bearing surface is inclined to the piston at an acute angle that opens in a direction opposite a setting direction.

In the ignition-ready position of the drive piston, the braking balls, which are supported against the ring spring, engage the outer surface of the drive piston.

When the drive piston moves in the setting direction, it entrains the braking balls therewith. The braking balls expand the ring spring, which results in the bearing surface transmitting the radial biasing force to the braking balls. In this way, the braking balls are pressed radially against the piston body by the ring spring, braking the same. Even with a small displacement of the drive piston in a direction opposite the setting direction, the braking effect can be substantially reduced or eliminated, as the braking balls displace in the same direction as the drive piston, unloading the ring spring. After being unloaded, the ring spring does not press any more the braking balls against the piston body.

The piston holder according to EPO 346 275 B1 has a rather complicated structure that includes a plurality of a braking balls, a braking ball-biasing ring spring and further springs that bias respective braking balls in a direction to the ring spring.

An object of the present invention is to provide a piston holder having a simplified design and which would reliably retain the drive piston in its ignition-ready position in the absence of ignition.

SUMMARY OF THE INVENTION

This and other objects of the present invention, which will become apparent hereinafter, are achieved by providing a piston holder for a drive piston of a setting tool that includes a circumferential groove provided in a stationary, with respect to the setting tool, component of the setting tool and surrounding the drive piston. The circumferential groove becomes shallower in a drive-out direction of the drive piston. The piston holder further includes an O-shaped helical tension spring located in the circumferential groove and concentrically surrounding the drive piston.

The O-shaped helical tension spring engages the piston body of the drive piston, applying a rather small bearing force and little friction. Because the O-shaped helical tension spring extends in the circumferential direction of the groove or the piston body, it is relatively long and, therefore, has a small spring rate. The small spring rate results in a small bearing force applied to the drive piston. The small torus diameter lies in the widened region of the groove which becomes shallower in the drive-out direction of the drive piston. The groove opens toward the guide channel, in which the drive piston is displaced, and has a bottom remote from the drive piston and which approaches the drive piston in the drive-out direction of the drive piston. When the drive piston is displaced in its drive-out direction, without the setting tool being ignited, it entrains the O-shaped helical tension spring therewith and the friction force between the spring and the drive piston increases, with the spring being displaced into the shallower portion of the groove. The increase of the friction force is caused by a radial deformation of the spring in the narrower of shallower section of the groove. When the force that pushes the drive piston in its drive-out direction is eliminated, the helical tension spring rolls back under the action of its spring force. Upon rolling back, the spring entrains the drive piston back, at least to some extent, returning the drive piston in its ignition-ready position.

Upon ignition of the setting tool, with the increase of the displacing force, the friction force between the helical tension spring and the drive piston is overcome, with the drive piston being able to drive a fastening element into a constructional component. Generally, the spring characteristics limit the friction forces in such a way that no section of the spring breaks. The friction forces are retained in an anticipated range. The friction forces are used for braking the drive piston. The O-shaped helical tension spring does not hinder return of the drive piston to its initial, ignition-ready position, as the friction between the spring and the drive piston becomes sharply reduced as the drive piston returns to its initial piston, with the spring being displaced in the deeper region of the groove where it does not apply any noticeable pressure to the drive piston.

The drive holder according to the present invention is easy to produce and is easy to mount. Therefore, it is very economical. Moreover, it is substantially maintenance-free.

According to the present invention, in order to form the O-shaped, helical tension spring, opposite ends of a straight section of a helical tension spring are screwed into each other, upon bending the straight section. By selecting the screw-in depth, the friction force between the helical tension spring and the drive piston can be adjusted.

For forming the O-shaped helical tension spring, two straight spring sections can be used, with the opposite ends of one section being screwed in opposite ends of the other spring.

The helical tension spring according to the present invention is more stiff in the screw-in region than in other regions of the spring. This results in that the forces imparted by the spring to the drive piston are not symmetrical. The drive piston is pressed radially against the guide channel, which results in generation of additional friction forces which adversely affect the return movement of the drive piston.

This drawback is eliminated by forming the O-shaped helical tension spring of two straight sections having the same length. With the formation of the O-shaped spring of two sections, two screw-in regions are offset relative to each other by 180° in the circumferential direction. Thereby, the unsymmetrical application of spring forces to the drive piston is eliminated.

With two screw-in location, the screwing is effected with the helical tension spring sections being twisted in opposite directions. With this, the spring ends of the two spring sections are held together, while the tension is reduced. With the opposite ends of the two spring sections being screwed into each other, they do not become loose by themselves, as the resiliency of the spring prevents unscrewing.

In order to increase the service life of the helical tension spring, according to the present invention, it is formed of a spring wire having a rectangular cross-section or of a stranded wire. In the later case, more wear material is available. On the other hand, with the helical tension spring being formed of a strand material, a certain redundancy is obtained. This means that the spring does not break rapidly when a strand is sheared off or is broken.

Further, the service life of a helical tension spring is increased when it is provided with a coating. As a coating, e.g., TiN-coating, TiC-coating, or a coating of a diamond-like carbon can be used. The coating, which is formed of one of the above-mentioned material or a material having similar characteristics, is relatively hard, which increases the stability of the spring. The foregoing coatings can be formed with the use of vacuum metallization, which permits to form them at a relative cold temperature. This prevents the helical tension spring from being damaged as a result of heat treatment.

Alternatively, the drive piston body itself can be decarburized. This not only increases the service life of the drive piston itself but also permits to make the drive piston body less hard than the spring. This also increases the service life of the spring.

The novel features of the present invention, which are considered as characteristic for the invention, are set forth in the appended claims. The invention itself, however, both as to its construction and its mode of operation, together with additional advantages an objects thereof, will be best understood from the following detailed description of preferred embodiments, when read with reference to the accompanying drawings.

BRIEF DESCRIPTION OF THE DRAWINGS

The drawings show:

FIG. 2 a partial cross-sectional view showing the position of a piston holder according to the present invention before the start of a setting process;

FIG. 3 a partial cross-sectional view showing the position of a piston holder according to the present invention during the setting process;

FIG. 4 a plan view of a helical tension spring for use as a piston holder and before being wound in an O-ring; and FIG. 5 a plan view of two helical tension springs of FIG. 4 joint together in form of an O-ring.

DETAILED DESCRIPTION OF THE PREFERRED EMBODIMENT

Figure 1:
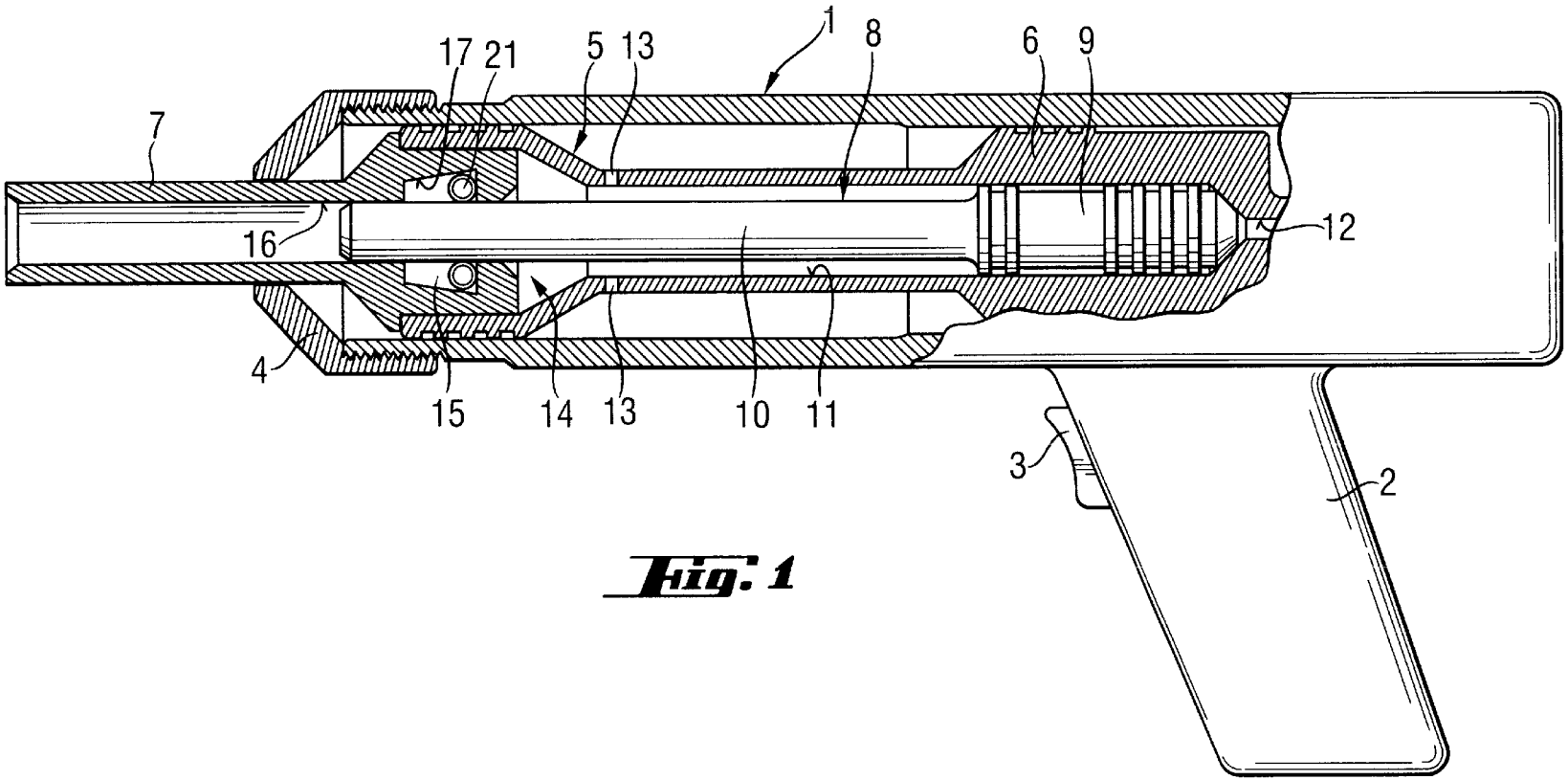
FIG. 1 a partially cross-sectional side view of a setting tool that can be equipped with a piston holder according to the present invention.

A piston holder according to the present invention can be used with a setting tool a partially cross-sectional view of which a shown in FIG. 1. The setting tool, which is shown in FIG. 1, is an explosive power charge-operated tool. However, the inventive piston holder can also be used in a setting tool driven upon ignition of an air-fuel mixture.

The setting tool, which is shown in FIG. 1, has a housing 1 with a handle 2 and a trigger 3 which, in the embodiment shown in FIG. 1, is provided in the handle. A stop socket 4 is screwed to the housing 1 at the housing end facing in the setting direction of the setting tool. A two-part piston guide 5 is displaceably arranged in the housing 1. The piston guide 5 is formed of rear and front parts 6 and 7, respectively. A drive piston 8 is arranged in the piston guide 5. The drive piston 8 has its head 9 displaceable in the rear part 6 and its body 10 displaceable in the front part 7. An inflow channel 12 for explosion gas of an explosive power charge opens into guide bore 11 of the part 6 at the rear end of the bore 11. At its front end, the part 6 has breakthroughs 13 for releasing air, which is accumulated in front of the piston head 9 of the piston 8 in the piston drive-out or setting direction. The front end region of the rear part 6 concentrically overlaps the rear region of the front part 7. The front part 7 extends beyond the stop socket 4 in the setting direction and forms a delivery tube. The rear end of the front part 7 can extend in form of a tubular projection into the guide bore 11, forming a stop limiting the travel of the drive piston 8.

The piston holder according to present invention can be located in a receiving region 14 provided in the region of the piston guide where the rear part 6 overlaps the rear end of the front part 7.

FIGS. 2–3 show the construction of the piston holder according to the present invention. A groove 15, which extends in the circumferential direction of the piston body 10, is formed in the rear end region of the front part 7. The circumferential groove 15 opens toward a guide channel 16 in which the piston body 10 is displaceable. The groove 15 has a bottom 17 and opposite side walls 18 and 19 extending transverse to the longitudinal axis 20 of the piston body 10. The radially extending, with respect to the piston body, wall 18, which faces in a direction opposite the setting direction of the setting tool, has a smaller radial height tan the opposite wall 19. In this way, the bottom 17 forms a conical surface, with the groove 15 becoming shallower in the setting direction.

A helical tension spring 21 is located in the groove 15. The helical tension spring 21 extends along the circumference of the groove 15 and, thus, is substantially coaxial with the piston body 10. The opposite ends of the helical tension spring 21 are inserted into each other.

A helical tension spring 21 which is used for forming a piston holder according to the present invention is shown in FIG. 4. One end 22 of the spring 21 has a coil diameter smaller than the rest of the spring 21 and tapers toward the end surface. The tapering end 22 of the spring 21, upon bending of the spring 21 to form an O-ring is screwed into the other, opposite end of the spring 21. The formed O-ring is placed into the circumferential groove 15, as shown in FIG. 2, in which the spring 21 is positioned against the rear, in the setting direction, wall 19 of the circumferential groove 15. As shown in FIG. 2, the spring 21 is not yet compressed radially in its wound direction. In the position of FIG. 2, the helical tension spring 21 imparts a minimal pressure or no pressure to the piston body 10.

Upon displacement of the drive piston 8 in its drive-out or setting direction, the piston body 10 entrains the spring 21 in that direction due to a small friction force acting therebetween. Because of the shallowness of the groove 15, the spring 21 will be compressed more and more as it is being displaced by the piston body 10 in the setting direction. The radial compression of the spring 21 results in an increased friction between the spring 21 and the piston body 10. When the piston-displacing energy, which is produced upon ignition of the setting tool, reaches its maximum, this energy overcomes the frictional forces imparted by the spring 21, and the drive piston 8 slides through the guide channel 16.

When the force that displaces the drive piston 8 in its. drive-out direction, is eliminated or is consumed, the spring 21 rolls back from the piston shown in FIG. 3 due to the stored biasing force therein, approaching the rear wall 19 and freeing the drive piston 8. This insures return of the drive position substantially friction-free, as the spring 21 does not hinder the movement of the drive piston 8. However, when the drive piston 8 moves in its drive-out direction, without the ignition process being initiated, e.g., upon the setting tool being pressed too hard against a constructional component, the biasing force of the spring 21 would provide for return of the drive piston 8 in its initial position.

FIG. 5 shows the use of two helical tension springs 21, 22 for forming the O-ring. In FIG. 5, the tapering end 22 of the first spring 21 is screwed into a wider end of the second spring 23 whereas the tapering end 24 of the second spring 23 is screwed into the wider end of the first spring 21. By using two helical compression springs 21 and 23 for forming an O-ring, an unsymmetrical loading of the piston body 10 of the drive piston 8 is avoided.

Though the present invention was shown and described with references to the preferred embodiment, such are merely illustrative of the present invention and are not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A piston holder for a drive piston (8) of a setting tool, comprising a circumferential groove (15) provided in a stationary, with respect to the setting tool, component of the setting tool and surrounding the drive piston (8), the circumferential groove (15) becoming more shallow in a drive-out direction of the drive piston (8); and an O-shaped helical tension spring (21) located in the circumferential groove (15) and concentrically surrounding the drive piston (8).

2. A piston holder according to claim 1, wherein opposite ends of a straight helical tension spring are screwed into each other, upon, bending the straight helical tension spring, to form the O-shaped helical tension spring (21).

3. A piston holder according to claim 1, wherein the O-shaped helical tension spring (21) is formed of two helical tension spring sections (21, 23) having a same length and having opposite ends of one spring screwed into opposite ends of another spring.

4. A piston holder according to claim 1, wherein the O-shaped helical tension spring (21) is formed of a spring wire having a rectangular cross-section.

5. A piston holder according to claim 1, wherein the O-shaped spring is formed of a stranded wire.

6. A piston holder according to claim 1, wherein the O-shaped helical tension spring has a coating.

7. A piston holder according to claim 6, wherein the coating is formed of one of TiN, TiC, and a diamond-like carbon.

8. A piston holder according to claim 6, wherein the coating is provided by a vacuum metallization process.

9. A piston holder according to claim 1, wherein the O-shaped helical tension spring (21) is formed of a material that is harder than a material of the drive piston (8).

* * * * *